United States Patent [19]

Potter

[11] 4,423,970

[45] Jan. 3, 1984

[54] PRINTING APPARATUS

[75] Inventor: John T. Potter, Locust Valley, N.Y.

[73] Assignee: Iquad Company Incorporated, Locust Valley, N.Y.

[21] Appl. No.: 407,841

[22] Filed: Aug. 13, 1982

Related U.S. Application Data

[63] Continuation of Ser. No. 190,680, Sep. 24, 1980, abandoned.

[51] Int. Cl.[3] ..... B41J 1/10; B41J 1/54

[52] U.S. Cl. ..... 400/141.1; 400/142

[58] Field of Search ..... 400/141, 141.1, 142; 308/6 R

[56] References Cited

U.S. PATENT DOCUMENTS

| | | | |
|---|---|---|---|
| 2,093,545 | 9/1937 | Bryce et al. | 400/141.1 |
| 2,224,546 | 12/1940 | Lottermann | 400/142 |
| 2,363,253 | 11/1944 | Larson | 400/142 X |
| 2,838,156 | 6/1958 | Griffith | 400/141.1 |
| 3,186,775 | 6/1965 | Beezer | 308/6 R |
| 3,207,067 | 9/1965 | Schaller | 400/152 X |
| 3,310,147 | 3/1967 | Clary et al. | 400/174 X |
| 3,326,346 | 6/1967 | Sasaki | 400/141.1 |
| 3,364,699 | 1/1968 | Hufstedler et al. | 308/6 R X |
| 3,554,347 | 1/1971 | Perkins | 400/320 |
| 3,717,234 | 2/1973 | Koller | 400/174 X |
| 3,892,303 | 7/1975 | Willcox | 400/142 X |
| 4,019,615 | 4/1977 | Gerry | 400/141.1 |
| 4,176,888 | 12/1979 | Teramachi | 308/6 R |

FOREIGN PATENT DOCUMENTS

| | | | |
|---|---|---|---|
| 343934 | 11/1921 | Fed. Rep. of Germany | 400/141.1 |

*Primary Examiner*—Paul T. Sewell

*Attorney, Agent, or Firm*—Nolte and Nolte

[57] ABSTRACT

Printing apparatus for printing characters in a line on paper has a print drum arranged horizontally with respect to the paper and is formed having the indexing means and the translational drive means affixed to the frame to greatly decrease the mass of the assembly. An actuator is arranged inside the print drum and a hammer arm extends at a 45° angle up and into the print drum to contact the actuator thereby driving a selected character outward into contact with the paper. The print drum includes rings having T-shaped characters slidably retained therein in a radial fashion. The characters are retained in the ring by means of a unitary elastic band which passes through slots formed in each type carrier.

8 Claims, 8 Drawing Figures

PRINTING APPARATUS

This application is a continuation application of my copending application, Ser. No. 190,680 filed Sept. 24, 1980.

BACKGROUND OF THE INVENTION

The present invention relates generally to cylindrical printing apparatus for use in a printing machine, such as a high-speed typewriter, and specifically relates to both an improved printing wheel and the system for moving the wheel and providing the printing operation.

There have been great advances in printing and typing machinery in the recent years. Such advances have replaced the mechanical key, lever, and hammer arrangement of original typewriters with an electromechanical system using a ball, drum, or wheel. The spherical golfball elements have proven to be very successful, however, they are limited in the speed in which they can be indexed. Additionally, the entire ball must be moved in order to strike the paper and this also limits the maximum printing speed.

As an advance over this kind of mechanism, and in order to increase indexing and printing speed, a rotatable wheel is known that employs the type elements located at the end of the thin radially arranged strips. This daisy wheel has a motor and encoder associated with it that, spins or indexes the wheel to the desired character location and a solenoid located behind the indexed character that is energized to strike the character to effect printing. This approach has also proven quite successful, however, in order to provide a sufficient number of characters, the physical spacing of the type around the daisy wheel requires a relatively large diameter wheel. Such large diameter wheels have attendant inertial problems and, thus, do not permit operation at extremely high speeds. In other words, the diameter of the daisy wheel limits the speed at which the wheel can be indexed. Additionally, the motor that spins the daisy wheel and the encoder that provides positional information must both be mounted for translational motion with the wheel, so too must the solenoid hammer mechanism. Thus, the typical assembly that is moved back and forth in front of the paper involves a daisy wheel mounted on the shaft of the indexing motor, an encoder mounted coaxially with the motor for providing rotary positional information to the logic of the machine so that the actual location of the daisy wheel is known at all times, and a solenoid for striking the indexed type element. This involves a large mass upwards of 16 ounces and entails a large number of electrical connections and wires. Typically, at least twenty individual wires must be connected to this movable assembly. This approach also usually involves the typewriter ribbon arranged in a cassette that is mounted for translational movement with the print wheel, drive motor, and solenoid arrangement. This further increases the mass that must be moved back and forth and also increases the number of electrical connections and wires, since most machines of this type utilize an end-of-ribbon sensor. The entire apparatus involving the daisy wheel, the drive motor, the encoder, ribbon, solenoid, ribbon cassette and the like is mounted on a movable carriage that is translated laterally with respect to the paper to be printed by a toothed belt or cable arrangement.

In regard to the actual means for printing, other approaches are also known, such as the drum arrangement utilized in teletype equipment and also ink-jet printers. The teletype drum approach is not suitable for use in a high-speed printer and, indeed, presents many of the same indexing problems inherent in the golfball kind of element. In the teletype drum arrangement, the drum is oriented with its longitudinal axis vertically and in order to shift back and forth between upper and lower case letters or to get to the various rows of type elements, it is necessary to move the entire printing assembly, since the hammer is located in a fixed position relative to the typing drum. Moving the typing drum up or down is usually done with a solenoid or magnet arrangement. These are slow and add to the complexity of the system. Ink-jet printers, while being high speed, suffer from being somewhat complex and also from the inability to produce carbon copies, thus, requiring a copying machine in order to produce multiple copies.

SUMMARY OF THE INVENTION

The present invention provides a rotary cylindrical printing apparatus for use in a printer such as a typewriter and, specifically, provides a printing apparatus made up of two rings that each contain individual type elements slidingly retained in a radial fashion. The type elements in one ring are in a staggered array with respect to the type elements in the other ring. Each individual type element is formed from a tee-shaped carrier having a type slug or character on the outboard surface. The carriers are slidingly arranged in the slotted annular rings, which are arranged concentrically, one against the other, to form a cylindrical array. The sliding type carriers are retained within each slotted ring by means of a single, concentrically arranged elastic ring. The cylindrical array formed of the two rings is arranged with its longitudinal axis horizontal, i.e., parallel with the axis of the paper roller or platen. The inventive printing apparatus provides very high-speed printing, and a fast-acting, solenoid-actuated hammer is arranged to drive an actuator assembly mounted inside the cylindrical array. A movable portion of the actuator assembly strikes the shank of each type character after the ring is indexed and the solenoid energized, so as to use true linear motion to impact the type.

Additionally, the motor used to index the printing drum is not movable with respect to the paper and is rigidly affixed to the frame of the machine, thereby drastically decreasing the quantity of mass which must be moved along with the printing mechanism. The solenoid-operated hammer is the only electrical apparatus which undergoes translational motion with the horizontally arranged, cylindrical typing drum. In a preferred embodiment, the ribbon is not contained within a cassette that moves with the typing wheel but, instead, is maintained in large spools located on either side of the paper and mounted to the frame of the machine. Therefore, the requirement that a ribbon cassette be moved in front of the paper, along with the printing wheel is eliminated.

The present invention reduces the number of individual electrical wires needed to connect the movable printing apparatus to the power and logic section, from in excess of twenty in known printers to only two. The indexing motor is located to one side and firmly affixed to the frame of the machine, and the print drum is slid along a shaft that is driven in rotary motion by this indexing motor. The present invention teaches the use of one, two, or four V-shaped slots or grooves milled into the shaft and the use of two linear ball bearings having a mutual 1° offset and specially arranged with respect to each of the slots in the shaft in order to rotate the printing drum mechanism with zero backlash. The printing apparatus itself, along with the actuator and the hammer, can be driven in lateral motion with respect to the front of the paper by means of a lead-screw arrangement. A yoke arrangement is affixed to a movable element on the lead screw, and a drive motor, also mounted on the frame of the apparatus, provides the rotary motion to the lead screw that results in lateral translational motion of the printing element.

The rotary indexing motor that turns the drum, the motor that drives the drum back and forth in front of the paper, the motors that control the ribbon movement and the solenoid actuated hammer can be under the control of a central logic unit, which forms no part of the present invention. This logic unit or cental command unit can be quite simple and straightforward or it can be as complicated as one wishes it to be. For example, using an electric typewriter keyboard, upon striking a character the drum is advanced one space, and rotated to the struck character and the solenoid energized briefly to cause the hammer assembly to strike the selected type element. These steps require only rudimentary logic employed in known electronic typewriters that is well within the skill of the routiner.

Therefore, it is an object of the present invention to provide a printing apparatus capable of extremely high-speed printing.

It is another object of the present invention to provide a high-speed, rotary, cylindrical printing apparatus, made up of rings that employ individual type characters, which are slidingly retained within radial slots in the rings.

It is still a further object of the present invention to provide a specialized means for slidably retaining type carriers in a slotted ring.

It is another object of the present invention to provide a rotary printing apparatus, which is horizontally arranged and indexed by a motor and shaft arrangement, wherein the motor is not movable with respect to the paper to be typed upon.

It is another object of the present invention to provide a printing apparatus, wherein the drive motor and encoder are affixed to the frame of the typing system and only the solenoid actuated hammer is translatable with respect to the paper and which requires only two electrical connections.

The manner in which these and other objects are accomplished by the present invention will become clear from the following detailed description.

DETAILED DESCRIPTION OF THE INVENTION

Figure 1:
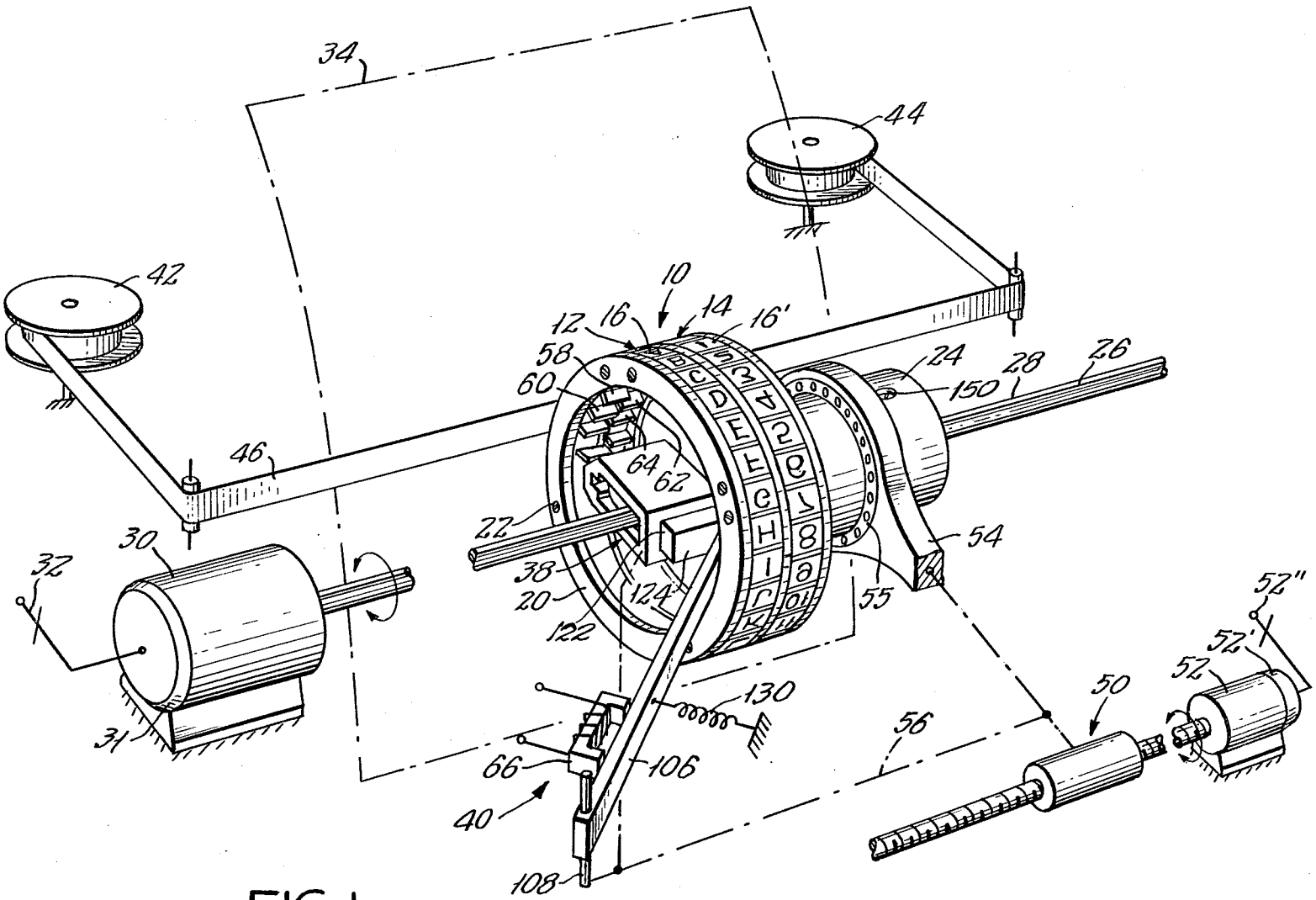
FIG. 1 is a perspective view of the inventive cylindrical printing apparatus.

Referring now to FIG. 1, the inventive cylindrical rotary printing apparatus is shown having two axially arranged annular rings and type carrier elements. Specifically, the rotary assembly 10 is formed of a first print ring assembly 12 concentrically arranged in contact with a second print ring assembly 14. The print rings, 12 and 14, are affixed together so that the circumferentially spaced type characters 16, 16' in their respective rings are in close lateral adjacency and are in staggered relationship between the two rings by a one-half character spacing, i.e., the space between two circumferentially adjacent type characters of one ring align with the middle of a type character in the laterally adjacent ring. While the present invention needs only a single type ring to use conventional English characters and Arabic numerals, two print rings have been found to provide optimum performance. In order to retain the sliding type characters in the slots of the first slotted print ring assembly 12, a retaining plate 20 is provided affixed to assembly 12 by screws or other suitable fasteners, shown typically at 22. The second slotted print ring 14 has the type elements arranged in slots and retained by a flat surface of the first ring 12. The assembly is affixed to a hub 24 that contains two linear bearings, which interact with a slot or groove 26 formed in the main drive shaft 28. The present invention teaches that this interaction occurs in a specific fashion to eliminate substantially any backlash. This is discussed in detail hereinbelow. The shaft 28 is rotated under the action of a rotary index motor 30 that includes an angle encoder 31 to provide information concerning the angular position of the motor shaft. The energization for the motor 30 and the connections for the encoder 31 is made through a multi-wire cable 32. Note particularly that this motor and encoder are represented as being firmly affixed to the framework or structure of the apparatus, and, thus, are immovable with respect to the sheet of paper, shown typically at 34. The motor 30 rotates the shaft 28, which is keyed to the hub 24 by interaction of linear bearings mounted in the hub 24 and the slot 26 formed in the shaft 28. Rotation of the shaft 28 causes the type rings 12 and 14 to rotate and, thus, indexing is provided.

The print ring assembly 10 is rotated by the motor 30 to the desired letter, thereby bringing the shank of the selected type carrier in front of the actuator assembly 38. Upon action of the solenoid and hammer assembly 40, a movable portion, the anvil 122, of the actuator assembly 38 is driven toward the paper 34 and the front of the movable portion 122 of the actuator assembly 38 strikes the shank of a type character in either ring 12 or 14 and causes the imprint to be made on the papper 34. A tape transport assembly formed of two driven reels 42 and 44, depicted diagramatically in FIG. 1 as supported by the frame is used to move a conventional typewriter ribbon 46 between the paper 34 and the print drum assembly 10. The actuator assembly 38 will be shown in more detail in a subsequent figure.

The lateral motion of the printing assembly is achieved by a lead screw and follower assembly 50 with rotary motion being provided to the lead screw by a motor 52 directed by encoder 52'. As with motor 30 and encoder 31, energization is made through a multi-wire cable 52". The translational motion is imparted to the printing assembly 10 by a yoke arrangement 54 which is arranged around the hub 24 and includes a ball bearing 55 that permits mutual rotation between the hub 24 and yoke 54 and also takes the side loading caused by the lateral motion. The actuator assembly 38 and solenoid and hammer assembly 40 travel with the printing assembly 10, and this is represented schematically by broken line 56.

In known printing drum assemblies, such as those used in Teletype equipment, the drum is arranged vertically and a magnet is used to shift between rows of characters. Were this approach to be followed in the present invention, it would be necessary to shift the assembly 10, either left or right, so that the appropriate ring 10 or 12 would be brought to bear in front of the actuator assembly 38. To avoid this shifting, the present invention teaches the use of two adjacent print rings, wherein the type elements are staggered or off-set by a spacing of one-half character. This means that the anvil of actuator assembly 38 can strike a type shank in both ring 10 and in ring 12. Striking of two characters simultaneously is prevented because of the off-set between the two rings. Thus, no shifting of the drum is required, all that is necessary is that the striking element of the actuator be sufficiently narrow in relation to the inter-element spacing so as to strike only one type element and that the lateral and rotational indexing control of the print drum have sufficient resolution to bring the appropriate type carrier shank in front of the actuator assembly 38. In FIG. 1, the stagger or off-set between type elements is seen in relation to type shanks 58 and 60 in ring 12 and type shank 62 and 64 in ring 12.

As seen from FIG. 1, the present invention teaches a printing assembly, wherein only the printing wheel and the hammer and actuator are required to be moved. Thus, only two electrical connection are required to be made to the movable assembly, i.e., those for the solenoid coil 66. No rotary motors or encoders are affixed to the printing wheel and no electrical connections are required. In one embodiment of the invention, the entire print wheel assembly, including hammer and solenoid, has been produced with a weight of only four ounces.

Figure 2:
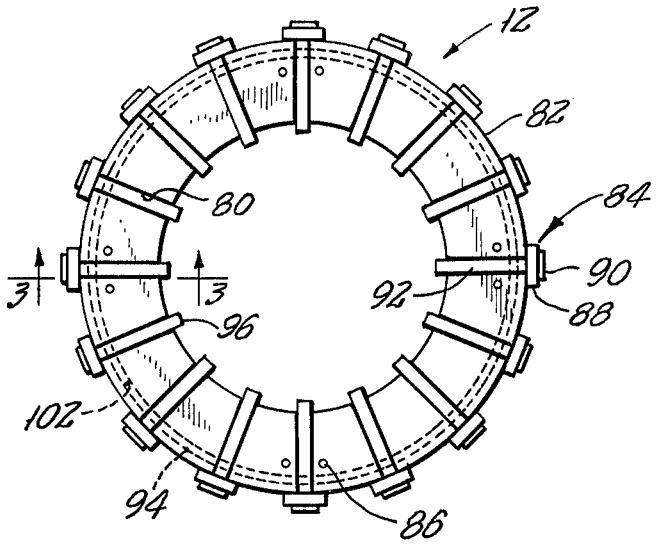
FIG. 2 is a top plan view of a one of the rings that makes up the print drum of the of the apparatus of FIG. 1.

FIG. 2 is a top plan view of one of the inventive print rings, which was shown in the assembly of FIG. 1. Specifically, the pring ring assembly 12 is shown in a top plan view, wherein it may be seen that the individual type carriers are radially arranged in slots 80 formed in ring 82. The radially slotted ring 82 may be formed of plastic, phenolic, or any other relatively strong light-weight material. The print wheel assembly 12 is intended to accomodate up to fifty individual type carriers, one of which is shown typically at 84. Tapped holes 86 are provided to cooperate with the fasteners 22 of FIG. 1. In that regard retaining plate 20 of FIG. 1 retains the type carriers 84 in their slots 80. The reverse side of the slotted ring 82, not seen in FIG. 2, is smooth and flat so that when the slotted ring assembly 14 is arranged next to it, this smooth, flat surface will retain the type elements i their slots, thereby maintaining minimum lateral spacing. In other words, the smooth flat surface of the reverse surface of slotted ring 82 performs the same function as the retaining plate 20.

Each of the type carriers 84 has formed on its radially external face 88 a type element 90. The shank 92 of each type carrier 84 extends into the central open area of the slotted wheel 82 and protrudes an amount sufficient to be struck by the actuator assembly 38 of FIG. 1 and, thus, to be driven radially outwardly. The present invention utilizes a unitary circular elastic element, shown in phantom at 94, to retract a driven type carrier. This will be described in detail below. The type carriers 84 are perferrably tee shaped, with the external face 88 forming the head or cross member and the shank 92 forming the leg or upright. It is understood that while FIG. 2 shows only a few type carriers, at least fifty such type carriers may be provided in one ring and, indeed, there is no upper limit to the number of carriers which may be provided, except until the overall bulkiness and mass of the assembly become prohibitive.

Figure 3:
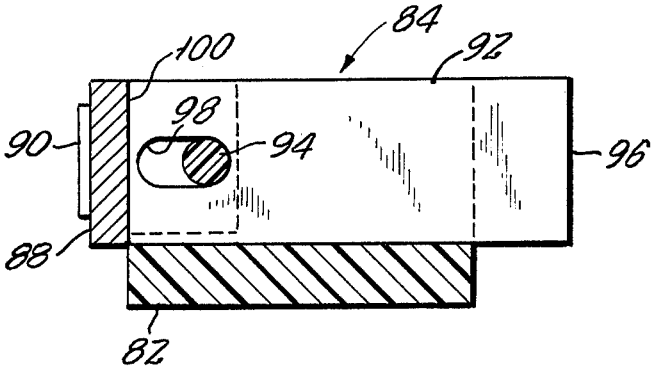
FIG. 3 is a side elevational view, in cross section, taken along section lines 3—3 in FIG. 2.

FIG. 3 is a side elevation in cross section taken along lines 3—3 of FIG. 2. This figure shows the manner in which the type carriers 84 are arranged in the radially slotted ring 82. The shank 92 of the type carrier 84 extends back through the slot 80 into the open central area of the slotted annular ring 12 where the rear surface 96 is struck by the actuator assembly 38 of FIG. 1. The type carrier 84 has a front surface 88 upon which the actual type face 90 is arranged. In order to return the type carrier 84 to its initial position after it has been struck on the rear surface 96 of the shank 92 by the actuator, a continuous, circular elastic element 94 is arranged through a hole or aperture 98 formed in the shank 92 of the type carrier 84. The aperture 98 is milled or drilled as a through slot in the shank 92 of the type carrier 84 adjacent the back or rear surface 100 of the head 88 of the type carrier.

The present invention teaches the use of the unitary continuous elastic element 94 to act as the return spring mechanism to return each individual type carrier 84 to its at-rest location after it has printed the character. This element 94 goes through the slot 98 formed in each of the type carriers 84. Therefore, in order to assemble the present invention, it is necessary to start with a length of the elastic material and to connect the two ends together after threading on all of the individual type carriers. This connection has been found to be advantageously performed by the use of one of the recently available "super glues", which usually includes cyanoacrylate. This connection is seen in phantom at 102 in FIG. 2.

Figure 4:
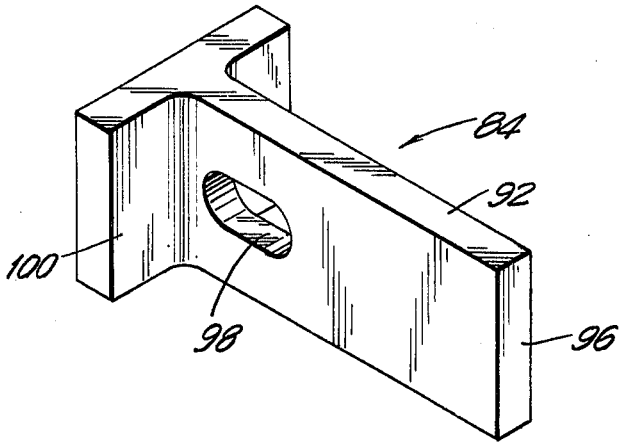
FIG. 4 is a perspective view of an inventive type carrier.

FIG. 4 shows a type carrier 84 in perspective and, specifically, the shank 92 is seen, as is the rear surface 100 of the head of the type carrier. The aperture 98 is formed as an elongated slot. This elongation is a part of the present invention and is provides so that when a specific type carrier 84 is struck on the rear surface 96 of the shank 92 and driven radially outwardly into contact with the printing surface, the single continuous elastic element 94, which retains all of the type carriers, will be able to move a short distance in relation to the type carriers adjacent the struck type carrier before its movement tends to draw the adjacent carriers outwardly. That is, the continuous elastic element 94 must travel the length of the slot 98 in the adjacent type carriers before it can then draw the outwardly also. The slot 98 is dimensioned based in part upon the outward extent of travel of the type carrier after it has been struck.

It has been found that the continuous elastic element 94 may be formed of the material normally used to make O-rings, which can be natural or synthetic rubber, such as Nytril. The material is cut tolength, the type carriers threaded on, and then the ends attached by means of the fast setting adhesive, such as the above-mentioned superglue containing cyanoacrylate, or Eastman 910.

Figure 5:
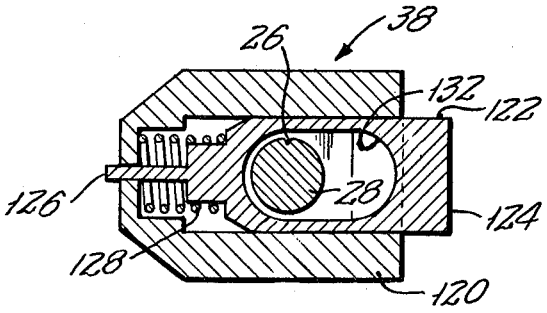
FIG. 5 is a perspective view of the hammer mechanism and actuator assembly partially in schematic form.

FIG. 5 shows the actuator assembly 38 of FIG. 1 in cross section. The manner in which the actuator is mounted to the movable print wheel assembly is not shown in FIG. 5, however, it is mounted to traverse the shaft 28 yet it retains a fixed attitude or orientation with respect to the paper 34. The actuator assembly 38 is the intermediate mechanical structure between the solenoid and hammer assembly 40 and the individual type elements 84 that make the impression on the paper 34. As seen in FIG. 1, the hammer arm 106 will provide an arcuate motion, since it is pivoted at one end 108 and energization of the solenoid coil 66 causes the hammer arm 106 to pivot around point 108. While this arcuate motion is acceptable in some instances, in the case of striking very accurate points and driving something like a type character straight ahead to provide a perfect impression, such arcuate motion is best avoided. Thus, the present invention employs the intermediate actuator mechanism 38, wherein the movable portion of the actuator can be made broad enough so as not to present a problem when impacted by a machine element following an arcuate path. The working end of the actuator then provides strictly linear motion to the shank of the type character.

The actuator assembly 38 comprises a rigid metal frame or shell 120. The frame 120 provides sufficient structural surfaces for mounting the actuator assembly for translational motion with the yoke 54 and lead screw follower 50, as represented schematically by dashed line 56 in FIG. 1. Arranged inside the frame 120 is a slidable anvil element 122. This slidable anvil element 122 has a rear surface 124 which is struck by the hammer arm 106 and a front surface 126 which interacts with the rear surface 96 of the type character shank 92. A compression spring 128 is arranged around a front circular portion of the anvil 122. One end of the spring 128 abuts an internal surface of the frame 120 and the other end abuts the front end of the anvil 122. In this way, upon exerting a force against surface 124, the anvil 122 is driven forward, or to the left in FIG. 5, and surface 126 contacts surface 94 of a type element driving it forward to make the impression on the paper. Upon de-energization of the solenoid coil 66, a spring 130 retracts the hammer arm 106 from surface 124 and spring 128 drives the anvil 122 backwards, or to the right in FIG. 5, returning the anvil 122 to its original position for subsequent printing. The actuator assembly 38 is mounted completely inside the type wheel assembly 10 and, thus, the shaft 28 passes directly through the actuator assembly. Therefore, a suitable clearance slot 38' must be formed through the frame 120 and the anvil 122. An elongated slot 132 is formed in the anvil 122, so that the anvil 122 can move back and forth yet not touch the shaft 28.

Figure 6:
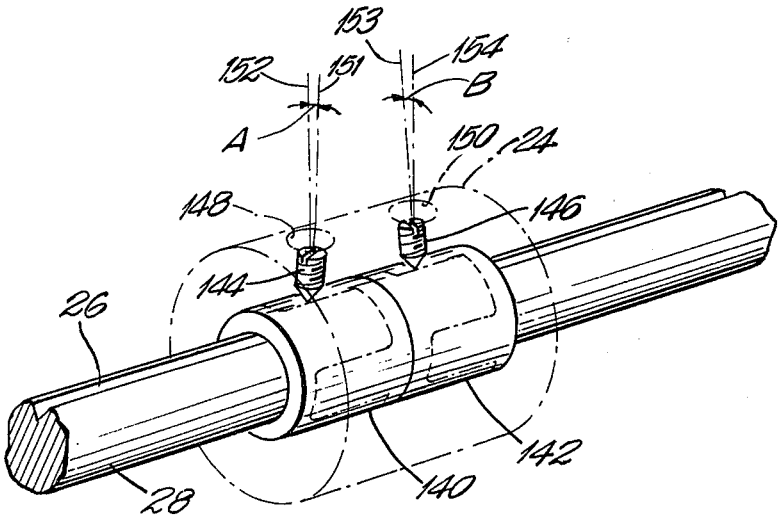
FIG. 6 is a detail showing the linear bearings in relation to the slot in the shaft of the assembly of FIG. 1.

FIG. 6 shows the relationship between the linear bearings arranged in the hub 24 and the groove 26 formed in the shaft 28, as shown in FIG. 1. FIG. 6 is a detail of the assembly in FIG. 1 and only a portion of the shaft 28 is shown. As described above, assembly 10 is caused to slide along the length of the shaft 28 and by turning the shaft 28 the assembly 10 is rotated correspondingly to index the type character to be printed at that time. In any mechanism where rotary motion of one machine element is imparted to another machine element, there is an inherent amount of backlash present. This is so because some working clearance between the two elements must be present. A common example of this is the interaction between two spur gears. Because the present invention relates to a high-speed printing apparatus that must of necessity be accurate in its indexing of characters, the amount of backlash present in the inventive system must be kept at a minimum. In order to eliminate most of the backlash, the present invention teaches the use of two linear ball bearings that operate in conjunction with the groove or slot formed in the shaft. Linear ball bearings are known and involve a single race that has a continuous serpentine path in which a plurality of balls are arranged.

In FIG. 6, a portion of the shaft 28 is shown and the groove 26 formed therein is shown in exaggerated proportion, in relation to the shaft diameter. That is, the groove is much smaller than as represented in FIG. 6. The linear bearings 140 and 142 are arranged coaxially and sequentially and are arranged inside the hub 24, a portion of which is shown in phantom. The anti-backlash arrangement of the present invention involves forcing one section of the continuous race of one linear bearing against one side of the groove 26 and and arranging the race in the next linear bearing to be against the opposite wall of the groove. This biasing or positioning is accomplished by means of set screws threaded into the hub 24. In FIG. 6, set screw 144 cooperates with linear bearing 140 and set screw 146 cooperates with linear bearing 142. These set screws are arranged for adjustment once the unit is assembled and access ports thereto are shown in phantom at 148, with respect to set screw 144, and at 150, with respect to set screw 146. In order to accomplish biasing the linear bearings on the corresponding opposite sides of the groove there must be a angular difference between the vertical axes of the set screws 144 and 146. As shown in FIG. 6, the vertical axes 151 of set screw 144 is shown in relation to the true vertical at 152 and the vertical axes 153 of set screw 146 is shown in relation to the true vertical 154. The actual angular amount by which the set screw angles are off the vertical is represented by angles A and B. These angles are accentuated in FIG. 6 in order to show the actual relationship, however, it has been found that an angular difference of one degree between the sets of bearings provides proper anti-backlash operation. That is, the sum of angle A and angle B would total only one degree.

Figure 7A:
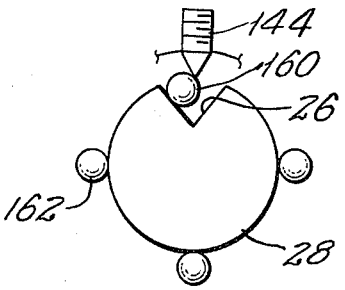
FIGS. 7A and 7B are schematic representations showing the relationship of individual balls of the linear bearings in relation to the slot in the shaft of the assembly of FIG. 1.
Figure 7B:
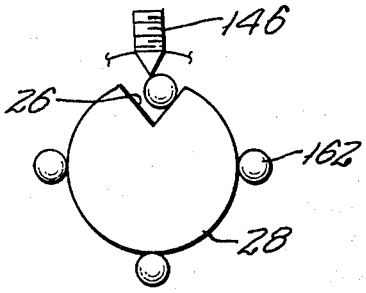

FIGS. 7A and 7B schematically represent the ball bearings in the races of the linear bearings as they cooperate with the shaft and groove. These drawings both are a representation of what might be seen in cross-section in FIG. 6 through the set screws and each of the balls shown in FIGS. 7A and 7B represent a number of balls arranged directly therebehind. In FIG. 7A, set screw 144 biases one of the races and, specifically, shown is ball 160 biased against the left hand or far side of the groove 35. Conversely, in FIG. 7B set screw 146 is angled to bias the one race of balls against the right or near side of groove 26 formed in shaft 28. It is understood, of course, that the set screws do not actually touch the ball bearings but exert a force against the metal sleeve that forms the body of the bearing and that defines the race. The balls in the other portions of the race are riding one the surface of the shaft 28; these other balls are represented typically at 162.

In operation then of the assembly shown in FIGS. 6, 7A and 7B, it is seen that by arranging the set screws 146, 148 to be at a particular angle (A and B) with respect to the vertical and tightening the set screws down, the four sections of the continuous race in each of the linear ball bearings act to cause the balls to be down in the working area in one race section, i.e., in the groove 26, and then up and around out of the working area in the other three races, i.e., against the nongrooved surface of the shaft 28. In this way, it is seen that a linear translational sliding motion is obtainable with essentially minimal backlash presented only by the mechanical tolerances of the assembly.

The foregoing is presented by way of example only and is not intended to limit the present invention, except as set forth in the appended claims.

What I claim is:

1. Apparatus for printing characters in a line on a sheet medium, comprising:

a frame;

a cylindrical print drum comprising two adjacent axially aligned rings formed with rectilinear radially extending ring slots and having a plurality of type characters, each being formed with a rectilinear shank and being radially movable in a respective ring slot from and to a seated position and a printing position, each said ring slot being formed as means for radially slidably restraining a respective shank substantially along its radial line of movement, said shanks having inner ends extending radially inwardly past the inner periphery of said respective rings when said type characters are in the seated position, each said type character shank being formed with a radially elongated shank slot, unitary circular elastic means arranged concentrically within each of said rings and extending through said shank slots of respective rings for radially retracting said type characters to a seated position from a printing position;

said type characters in one said ring being circumferentially staggered relative to said type characters in the other said ring by half of the circumferential dimension of a type character, said print drum being arranged with its axis parallel to the line of characters to be printed;

a typewriter ribbon extended for interposed relationship between said print drum and the medium, and reeling means mounted on said frame for transporting said ribbon in alignment with the line of characters to be printed;

rotary drive means mounted on said frame and including a shaft for rotating said print drum to circumferentially orient a selected type character for printing on the medium;

means mounting said print drum on said shaft for rotary movement therewith and for translational movement therealong;

translational drive means mounted on said frame for providing translational motion to said print drum in relation to the medium to laterally orient either one of said rings and said selected type character for printing on the medium;

means for striking said selected character for moving the same radially toward the medium, said character striking means comprising an actuator assembly including a frame and an anvil slidable therein, said frame and said anvil having aligned apertures, elongated in the direction of said selected character, said shaft of said rotary drive means extending along the axis of said cylindrical print drum through said elongated apertures of said actuator assembly, said anvil having a forward striking face extending parallel to the axis of said print drum and comprising means for striking said inner end of said selected type character in either of said rings without translational movement of said actuator assembly relative to said cylindrical print drum;

said translational drive means including a lead screw and follower assembly, said lead screw extending in spaced relation and parallel to the common axis of said shaft and cylindrical drum;

means connecting said print drum mounting means to said follower assembly for translational movement therewith; and means mounting said type character striking means within said drum and to said follower assembly for translational movement therewith.

2. Apparatus of claim 1, wherein said shaft has a straight longitudinal groove formed therein, said print drum mounting means including a hub and linear ball bearing means are interposed as key means between said hub and the surfaces of said shaft and groove for inhibiting backlash between said hub and said shaft.

3. The apparatus of claim 1, wherein said striking means further comprises solenoid coil means having an actuatable arm extending within said print drum for striking said anvil.

4. The apparatus of claim 1, wherein said translational drive means further comprises a drive motor and encoder means for rotating said lead screw, said drive motor and encoder means being mounted to said frame.

5. The apparatus of claim 2, further including means in said hub for biasing said linear ball bearing means into pressing contact with said surfaces of said groove in said shaft.

6. The apparatus of claim 5, wherein said linear ball bearing means includes a first and a second linear ball bearing mutually axially arranged on said shaft, said biasing means biasing said first linear ball bearing against a first side surface of said groove in said shaft and biasing said second linear ball bearing against a second side surface of said groove in said shaft.

7. Apparatus for printing characters in a line on a sheet medium comprising:

a cylindrical print drum with its axis parallel to the print medium mounted by a hub to a rotary drive shaft for rotation therewith and translational movement therealong, said drum comprising axially adjacent rings, each ring having a plurality of circumferentially disposed print characters with elongated shanks radially slidably retained in slots in their respective rings with said shanks extending within the inner peripheries of said rings, said slots and shanks of one said ring being circumferentially staggered relative to the slots and shanks of the adjacent ring whereby the slots and shanks of one said ring extend in axial planes extending between circumferentially adjacent type characters in the adjacent ring; and an actuator assembly comprising a frame and an anvil radially movable therein, disposed within the inner peripheries of said rings and mounted for coincidental translational movement therewith, the anvil having a shank striking face axially elongated for striking a shank of said one ring or of the adjacent ring without translational movement of said actuator assembly relative to said cylindrical print drum;

8. The apparatus of claim 7, wherein said frame and anvil of said actuator assembly have axially aligned apertures and said rotary drive shaft extends through said apertures.

* * * * *